US005540192A

United States Patent [19]

Xanders

[11] Patent Number: 5,540,192

[45] Date of Patent: Jul. 30, 1996

[54] INTEGRATED WATER PUMP ASSEMBLY FOR INTERNAL COMBUSTION ENGINES

[75] Inventor: Roy Xanders, Fairfield, Ill.

[73] Assignee: UIS, Inc., New York, N.Y.

[21] Appl. No.: 450,364

[22] Filed: May 25, 1995

[51] Int. Cl.[6] ..... F01P 5/10

[52] U.S. Cl. ..... 123/41.44; 415/213.1; 29/888.024

[58] Field of Search ..... 123/41.44, 41.47; 415/213.1, 215.1; 29/888.024

[56] References Cited

U.S. PATENT DOCUMENTS 4,715,780 12/1987 Kan ..... 415/200
4,768,923 9/1988 Baker ..... 415/201

*Primary Examiner*—Noah P. Kamen

*Attorney, Agent, or Firm*—Andrus, Sceales, Starke & Sawall

[57] ABSTRACT

A water pump assembly for an internal combustion engine includes an integrated bearing and seal unit consisting of a separate bearing and seal collar in combination with a single piece stamped steel housing. The bearing collar is machined to a standard bearing bore size and a bearing is secured within the bore. The housing includes a flat mount member connected by a conical wall to an elongated tubular flange having an internal diameter slightly greater than the outer diameter of the collar and a length substantially equal to one half the collar length. The collar has an outer enlarged recessed ledge over the inner seal end which is slightly longer than the housing flange. The flange internal diameter is slightly greater than the ledge. In assembly, a plurality of brazing rings are interposed between the enlarged collar and flange, and a brazed joint is formed throughout the elongated interface between the collar and flange. The brazed housing provides the support for the bearing assembly to the engine.

13 Claims, 1 Drawing Sheet

INTEGRATED WATER PUMP ASSEMBLY FOR INTERNAL COMBUSTION ENGINES

BACKGROUND OF THE INVENTION

This invention relates to an integrated water pump assembly for internal combustion engines.

Water pumps for circulating of engine cooling water to internal combustion engine blocks are generally mounted to a housing structure supporting a rotary shaft in a rotary bearing assembly or unit, with the shaft projecting outwardly for interconnection to a driving member coupled to the engine drive system at one end and a water circulating impeller affixed to the opposite end of the shaft. The integrated assembly includes a housing secured to the rotary bearing structure or unit with a radial flange for mounting of the water pump assembly to the engine block. In the prior art, the housing is generally an annular plate-like member having an opening corresponding to the outer diameter of the bearing unit. The bearing unit may be formed with an outer collar within which a separate bearing member is press-fitted. Alternatively, the outer bearing race is extended and forms the outer wall structure of the bearing unit. Either the collar or the bearing wall is extended to receive a rotary seal at the impeller end. The housing is secured to the outer wall of the bearing unit at the seal end. For example, U.S. Pat. No. 4,768,923 discloses a prior art water pump housing assembly consisting of a bearing having the outer bearing race extended to receive a spring loaded seal unit. The housing plate is a generally annular plate having an opening substantially corresponding to the outer diameter of the outer bearing wall or race at the seal end. A wall of the sealing structure is also telescoped over the adjacent outer end of the outer bearing wall with the sealing wall and the edge of the pump housing, the bearing wall and the sealing wall interconnected to each other by a suitable weld or the like. Commercial prior art structures which have been used in connection with internal combustion engines have used similar bearing structures as well as the bearing structures having a separate collar with the bearing press-fitted into one end of the collar and a seal unit press-fitted or otherwise secured in the opposite end of the collar. A housing member generally in the form of a suitable flat metal plate having a central opening is secured to the end structure. In the commercial structures, the opening in a stamped housing has an outwardly opening small connecting flange defining the attachment opening. The connecting flange is of a length generally equal to the portion within which the sealing structure is located and is interconnected over the relatively small area of the flange. The interconnection, in the prior art, has suggested the use of a laser weld or alternatively a brazed joint as the method of securing the small metal flange to the collar or outer wall of the outer bearing race. A brazed joint is desirable as it allows the manufacturer or fabricator to utilize standard existing manufacturing processes that generally do not require specialized fixture systems.

Although the prior art has been employed in a satisfactory application to internal combustion engines for vehicles and the like, there is a continuing demand for pump housing structures which can be produced in a more cost effective structure and one which has the long reliable operating life. Thus, the component, fabrication, and assembly procedures and costs are integral considerations in connection with an appropriate design of a water pump. Further, it is highly desirable to permit recovery of certain component parts, such as the bearing member in the event damage occurs to the external assembly of the pump assembly without damage to the bearing, the seal unit or the like. Thus the integral structures, such as shown in the subject patent, would provide an integral welded or other fixed interconnection between the seal, the bearing structure and the housing and generally require scraping of the complete housing assembly because of the integral nature of the components.

Thus, there is a need for continuing improvement in the development of water pump housing assemblies for internal combustion engines and the like.

SUMMARY OF THE PRESENT INVENTION

The present invention is particularly directed to a new water pump housing assembly with an integrated bearing and seal unit which is readily fabricated using known and present technology permitting initial cost effective fabrication as well as possibility of recovering of components in the event of damage to the housing structure as such. Generally, in accordance with the present invention, the water pump housing assembly includes a special tubular support wall or separate bearing collar in combination with a single stamped metal housing in the form of annular ring-shaped housing having a substantially L-shaped cross-section including an integral connecting flange which projects substantially outwardly to the bearing end of the assembly over a substantial portion of the collar and an integral radial attachment flange or plate for mounting of the housing to the internal combustion engine. The surface of the separate bearing collar is machined to a standard bearing bore size. The manufacturer then has the option of using any one of a number of bearing manufacturing sources and allows the negotiation of a most effective source for the bearing assembly as such. In addition, the seal assembly is readily adapted to the bearing bore size. Further, with the separate collar structure and the bearing flange solely interconnected to the collar without interconnection to other components, damage to the outer housing structure permits recovery of the bearing assembly if no damage has occurred thereto as well as to the seal unit.

In carrying out the present invention, the interconnection between the collar and the housing is significant to establishing and maintaining a reliable long life assembly. In particular, the flanged housing has an elongated tubular flange with an internal diameter slightly greater than the outer diameter of the collar. The tubular flange length is such as to project over a very substantial portion of the collar, and generally approximately fifty percent thereof. In fabrication, a plurality of brazing rings or other brazing elements are interposed between the collar and connecting flange, with the assembly then heated to develop a brazed joint throughout the elongated interface between the collar and the flange. In a preferred and particularly practical implementation, the collar is formed with an outer enlarged ledge over the connecting tubular flange receiving portion. The ledge is somewhat longer than the connecting tubular flange length and is recessed to receive the connecting tubular flange, with an outer locating lip for accurate factory assembly of the housing to the collar during fabrication and creation of the brazed joint. The inventor has found that this provides a particularly advantageous fabrication procedure as well as a final high strength housing structure to which the bearing assembly is securely affixed while permitting the efficient and cost effective attachment to the engine block.

The integrated bearing housing assembly of the present invention provides a compact high strength housing permitting possible recovery of component parts, if necessary, and thus provides a highly cost effective bearing assembly.

BRIEF DESCRIPTION OF THE DRAWING

The drawing furnished herewith illustrates a preferred construction of the present invention in which the above advantages and features are clearly disclosed as well as others which will be readily understood from the following description of the illustrated embodiment.

In the drawing.

DESCRIPTION OF THE ILLUSTRATED EMBODIMENT

Figure 2:
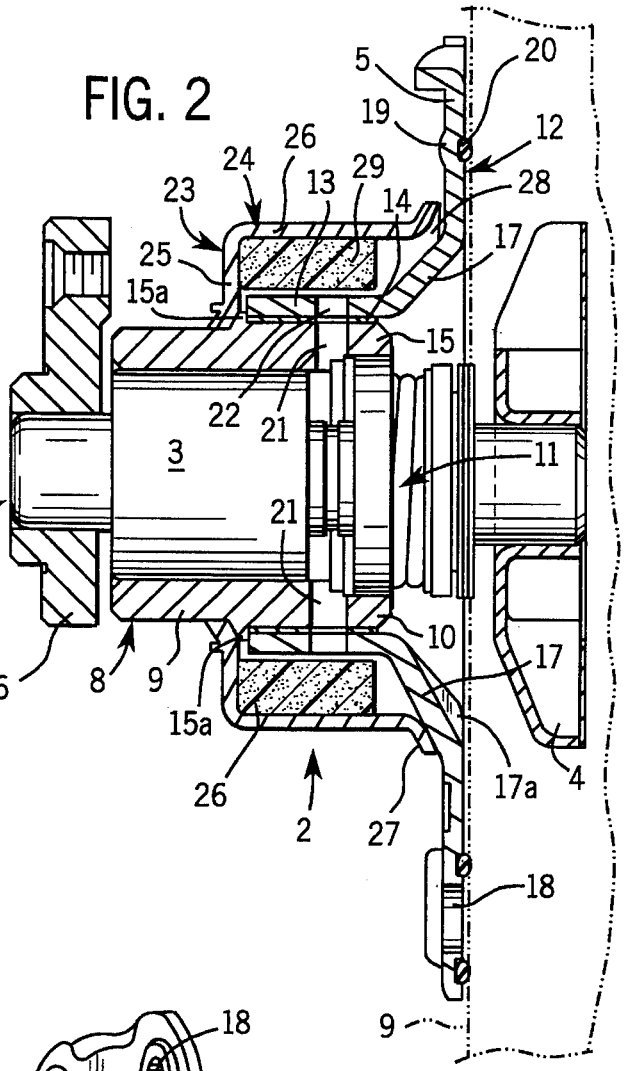
FIG. 2 is an enlarged axial cross-sectional view of the housing unit with a pump drive assembly within the housing.
Figure 1:
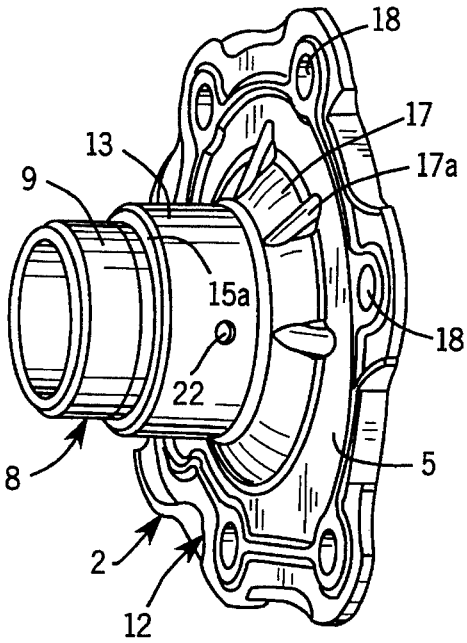
FIG. 1 is a pictorial view of a water pump housing unit illustrating an embodiment of the invention.

Referring to the drawing and particularly to FIGS. 1 and 2, a shaft 1 is rotatably journaled within a housing assembly or unit 2 having a bearing unit 3 secured within the housing unit 2. The shaft 1 projects from the opposite ends of the housing unit 2 to receive an impeller 4, shown adjacent to a radial mounting plate 5 of housing unit 2, and a drive member 6 to the opposite end. The plate 5 is secured to an engine block 7, shown in phantom in FIG. 2, to locate the impeller 4 within a pump chamber and the drive member 6 located in selected location with respect to the block 7. The drive member 6 is coupled to the engine drive system, not shown, in accordance with any known coupling system.

The present invention is particularly directed to the construction and fabrication of the housing unit 2 for receiving the bearing unit and a seal unit, and the latter elements are therefor only described as necessary to a full understanding of this present invention.

Referring particularly to FIG. 2, the housing unit 2 generally includes a tubular collar 8 having an internal machined surface including an outer bearing portion 9 and a spaced inner seal portion 10. The separate rotary bearing unit 3 is press fitted into the first and outer bearing portion 9 of the collar 8 to firmly and fixedly support the bearing unit in place. The second and spaced inner seal portion 10 of the collar 8 is machined to receive a seal unit 11 to provide a substantially liquid tight seal about the shaft 1 just outwardly of the impeller 4. The bearing unit 3 may be any one of a different standard bearings having an outer finished wall of a diameter for press fit or other securement within the annular collar. This permits cost effective negotiations with respect to the bearing cost, through negotiations with different manufacturers and sources. Similarly, seal unit 11 may be manufactured by the fabricator or purchased from outside sources.

More particularly, the housing unit 2 is formed with a relatively separate heavy collar 8. A single piece housing 12 includes the radial plate 5 and an elongated tubular flange 13 projecting over substantially one half the length of the collar 8. The flange 13 is interconnected to the collar 8 along the elongated interface, preferably by a brazed joint 14. The single piece housing 12 is a stamped metal member of a relatively heavy steel plate.

The exterior of the collar 8 is specially formed with a raised ledge 15 in the form of an other circumferentially enlarged portion which extends outwardly from the seal end of the collar. The length of the ledge is preferably at least one half the length of the collar and in practice is slightly in excess of such length. The outer circumferential face of the ledge 15 is formed with a recess to define an outer locating lip 15*a*. The diameter of the recess in ledge 15 and the internal diameter of the tubular flange 13 are specially related. The outer diameter of the ledge recess is slightly less than the internal diameter of the tubular flange 13 to define a small interface gap for receiving the brazing material 14 throughout the interface, as shown in FIG. 3.

Figure 3:
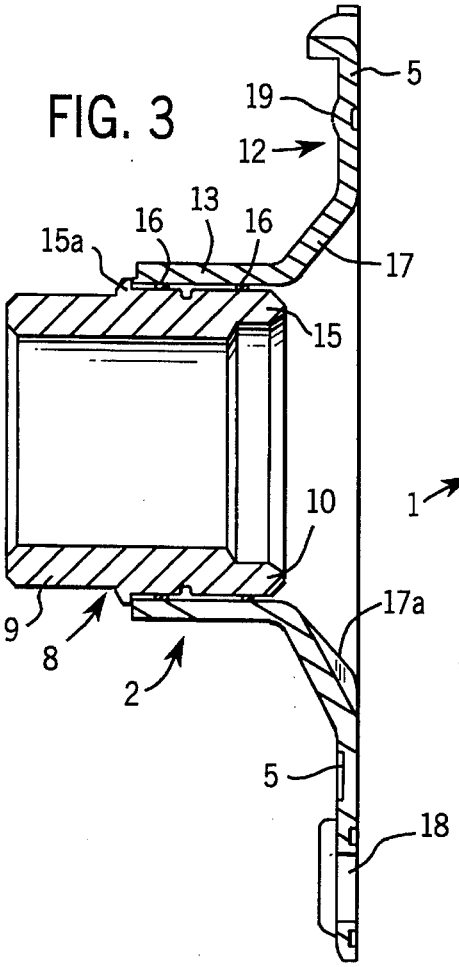
FIG. 3 is a view illustrating the fabrication of the housing unit of FIG. 1.

Referring to FIG. 3, the collar 8 and housing 12 are assembled with tubular flange 13 aligned with the ledge 15 in a suitable brazing fixture, not shown, with a plurality of brazing rings 16 interposed within the gap therebetween. In the illustrated embodiment of the invention, a pair of annular brazing rings 16 are located in position between the interface of the recessed collar 8 and flange 13. The assembly is then heated to establish the brazed joint 14 extending throughout the length of the interface of the flange 13 and the recessed ledge 15 of the collar 8. In accordance with well known phenomena, heating of the assembly liquifies the brazing material which flows as a result of capillary action to completely fill the interface between the tubular flange 13 and the recessed collar 8. The result is an extended and highly reliable and effective connection between the tubular flange and the collar.

The radial plate 5 has a generally frusto-conical portion 17 which extends axially and radially outwardly from flange 13 and the end of collar 8 and terminates generally in alignment with the outer end of the spring loaded seal unit. The conical portion 17 has offset strengthening portions 17*a*. The radial plate 5 extends radially outwardly to form an outer flat wall member. A plurality of circumferentially spaced bolt openings 18 in the plate 5 provide for bolting of the housing 2 with the flat wall member in abutting and sealed engagement with a finished face of the engine block. In the illustrated embodiment of the invention, the radial plate 5 includes an offset portion defining a slight circumferential recess 19 on the face of the plate. The recess 19 also extends about the bolt openings 18. An annular seal 20 is disposed within the recess 19 including the bolt openings to provide an effective seal at the interface of the housing plate 5 and the engine block 7.

The collar 8 may be formed with a plurality of openings 21 for discharge of any liquid which may pass through the seal unit 11. The tubular flange 13 is then also formed with a corresponding plurality of similar openings 22 aligned with the openings 21 in the collar 8. In the illustrated embodiment of the invention, a sponge-filled collection chamber 23 collects the water for evaporation into the atmosphere, as follows.

The collection chamber 23 is secured to the collar 8 outwardly of flange 13. The chamber 23 includes a generally L-shaped wall 24 encircling the attachment plate 5 including the frusto-conical portion 17 of the attachment plate 5. The chamber wall 24 has a radial leg 25 welded or otherwise secured to the bearing collar 8 abutting the exterior of the lip 15*a*. The annular leg 26 of the wall 24 encircles the tubular flange 13, with the outer end portion angled outwardly as at 27 in accordance with the frusto-conical wall 17, with a substantial portion of the angled portion abutting the frusto-conical wall 17. Thus, the abutment extends circumferentially throughout the bottom and side portions of the housing. At the upper end of the frusto-conical wall 17 of the housing, the angled portion 27 is spaced outwardly from the housing to define an exit opening 28 for evaporation of the water into the surrounding environment. An absorbent material 29, such as a suitable plastic sponge material, substantially fills the annular chamber including the transfer opening. The water is thus held within the chamber and allowed to evaporate through the top wall opening 28.

The integrated assembly with the special collar to allow acceptance of various available bearing units and salvage in the event of housing damage and elongated tubular flange of the housing, particularly with the elongated brazed joint, has been found to provide a highly cost effective integrated water pump assembly for automotive vehicles and like internal combustion applications. The collar and housing can be readily formed of compatible materials for brazing with the collar appropriately shaped to receive and support an integral separate bearing unit. The housing which forms a single support for the assembly is readily formed as a low cost steel stamping, with the brazing of the elongated tubular flange to the collar providing a long life attachment and low cost joint as a result of the extension throughout a substantial portion of the collar. The locating lip provides a simple and effective fabrication assembly control.

The present invention thus provides an improved vehicular type water pump in which a bearing collar is specially constructed to receive an integrated special pump housing and seal structure which is readily interconnected to establish an integrated assembly. The assembly fabrication particularly permits a precise, accurate location of the relative components for reliable attachment to the engine block.

Various modes of carrying out the invention are contemplated as being within the scope of the following claims particularly pointing out and distinctly claiming the subject matter which is regarded as the invention.

I claim:

1. An integrated water pump apparatus for mounting to a vehicle engine block having a water pumping chamber, a bearing and sealing unit including an outer tubular support wall having a first end and a second end and having a bearing unit securely located within the first end of said support wall and a sealing unit sealed within the second end of said support wall, a shaft rotatably mounted within said bearing and sealing unit, said shaft projecting outwardly from the first and second ends of said support wall, an annular ring-shaped pump housing having a generally L-shaped cross-section including a tubular flange telescoped over the second end of said support wall and having a length corresponding about half the length of said support wall, and a connecting material interposed within the interface between said support wall and said tubular flange, said pump housing having a generally radial member adapted to be secured abutting an engine block for mounting of the water pump apparatus to the engine block and said flange forming a single support for said pump apparatus on said engine block.

2. The pump apparatus of claim 1 wherein said support wall includes an outer ledge located substantially centrally of said tubular support wall between said first and second ends, said ledge having an exterior recess extending from said second end throughout substantially the entire length of the ledge and defining an outer radial locating lip projecting outwardly, said tubular flange being located in said recess.

3. The pump apparatus of claim 1 wherein said connecting material is a brazed connection between said tubular flange and said support wall throughout the interface between said tubular flange and skid support wall.

4. The apparatus of claim 1 wherein said tubular support wall includes a finished inner cylindrical opening adapted to receive said bearing unit within said first end and an annular seal assembly within said second end, said tubular support wall having an outer cylindrical configuration and including an outer circumferentially enlarged ledge receiving said tubular flange.

5. The apparatus of claim 4 wherein said outer enlarged ledge includes an outer recess extending inwardly from said second end and terminating in a radial lip abutting the end of said tubular flange, and having a brazed joint connecting said tubular flange to said enlarged ledge.

6. The water pump apparatus of claim 1, wherein said tubular flange of said housing has an inner diameter slightly larger than the outer diameter of said outer support wall, whereby said flange is assembled with said support wall with a spacement therebetween for interposing of brazing material therebetween.

7. An integrated water pump apparatus for mounting to a vehicle engine block and including an integrated water pump bearing and seal assembly, comprising a collar having an internal cylindrical finished wall and having a first end and a second end, a bearing unit securely located within the first end of said collar with said collar extending outwardly to the second end, a, a sealing unit secured within the second end of said collar, a rotatable shaft rotatably mounted within said bearing unit and said sealing unit, skid shaft projecting outwardly from the first and second ends of said collar, said collar having an outer ledge extending generally throughout the half of said collar including said second end, said ledge having a locating outer recess extending from the second end of the collar throughout substantially the entire length of the ledge and defining an outer radial locating lip projecting outwardly of the collar, a pump housing formed of a metal suitable for stamping and being an annular ring housing having a generally L-shaped cross-section including a tubular flange corresponding substantially in length to said recess of said collar, a brazed joint throughout the interface of said tubular flange and said recess and forming the single support of said housing to said collar, said pump housing having a generally radial plate having a sealing face adapted to be secured abutting a flat wall of an engine block, said shaft extending from said second end adapted to receive an impeller of a water pump apparatus to the engine block and adapted to establish a sealed interconnection about said impeller end of said apparatus.

8. The apparatus of claim 7 wherein said plate includes an integral radial mount portion and an inclined portion extending from said radial mount portion to said tubular flange, said radial outer portion substantially aligned with the outer end of the sealing unit and said integral radial mount portion having a substantially planar sealing face.

9. The water pump apparatus of claim 7 including a space between said seal unit and said bearing unit, said tubular flange and support wall having openings permitting water leakage through said seal with said space, a collection chamber wall including a tubular wall surrounding said collar and secured to said collar adjacent the end of said tubular flange, and a circumferential wall extending from said tubular wall to said mounting plate, a liquid tight connection of said circumferential wall to said plate throughout the bottom and sides of said plate, and said top of said circumferential wall being flared outwardly in spaced relation to said plate.

10. The water pump apparatus of claim 9 including a water absorbent material substantially filling said collection chamber.

11. An integrated water pump housing unit, comprising a supporting collar for receiving a bearing unit in one end and a seal unit in the opposite end, mounting housing having a tubular flange of a length and corresponding to substantially half the length of said collar and a mounting plate extending radially outwardly from said flange for interconnection apparatus to an engine block, and a brazed joint connecting said tubular flange to said collar with said plate located outwardly of said collar and forming the sole securement of the housing to said collar.

12. The pump housing of claim 11 wherein said collar has a raised ledge with an outer recess, and said tubular flange and brazed joint are located totally within said recess.

13. A method of fabricating an integrated water pump mounting assembly to an engine block with a pump shaft terminating in a water pump chamber of an engine block, said assembly having a supporting braising collar having a seal end and a bearing end for receiving of a bearing unit in said bearing end and a seal unit in said seal end to support a pump shaft, said collar having an outer round surface, and wherein said collar has a recess in said outer round surface throughout substantially one-half the length of the collar and extending inwardly from said seal end, in combination with annular ring-shaped housing having a substantially L-shaped cross-section including a tubular flange of a length and inner diameter substantially corresponding to said recess and a radially outwardly extending mounting plate for interconnection to an engine block, comprising the steps of assembling of said tubular flange within said recess of said collar, interposing a plurality of annular brazing rings between said flange and said collar with said brazing rings spaced axially from each other, heating of said assembly to braze said elongated flange within said recess of said collar and thereby provide a single attachment of said radial plate to said collar, said plate having attachment members for securing said plate to a vehicle engine block to support said pump shaft within said pumping chamber.

* * * * *

UNITED STATES PATENT AND TRADEMARK OFFICE

CERTIFICATE OF CORRECTION

PATENT NO. : 5,540,192

DATED : July 30, 1996

INVENTOR(S) : Roy Xanders

It is certified that error appears in the above-identified patent and that said Letters Patent is hereby corrected as shown below:

Column 5, line 60, CLAIM 3, after "and" and before "support" delete "skid" and substitute therefor ---said---; Column 6, line 18, CLAIM 7, after "end" delete "a,"; Column 6, line 20, CLAIM 7, before "shaft" delete "skid" and substitute therefor ---said---.

Signed and Sealed this

Twenty-seventh Day of May, 1997

*Attest:*

Bruce Lehman

BRUCE LEHMAN

*Attesting Officer*

*Commissioner of Patents and Trademarks*